US007593654B2

(12) United States Patent
Ramesh et al.

(10) Patent No.: US 7,593,654 B2
(45) Date of Patent: Sep. 22, 2009

(54) MASS-BASED SENSING OF CHARGING KNEE FOR ACTIVE CONTROL OF CHARGER SETTINGS

(75) Inventors: Palghat S. Ramesh, Pittsford, NY (US); Aaron M. Burry, West Henrietta, NY (US); Christopher A. Dirubio, Webster, NY (US); William C. Dean, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 471 days.

(21) Appl. No.: 11/623,361

(22) Filed: Jan. 16, 2007

(65) Prior Publication Data

US 2008/0170869 A1 Jul. 17, 2008

(51) Int. Cl.
*G03G 15/00* (2006.01)

(52) U.S. Cl. ..... 399/48; 399/49; 399/50; 399/174

(58) Field of Classification Search ..... 399/48, 399/49, 50, 174
See application file for complete search history.

(56) References Cited

U.S. PATENT DOCUMENTS 5,797,064 A * 8/1998 Raj et al. ..... 399/46
6,611,665 B2 8/2003 DiRubio et al.
6,807,390 B2 10/2004 Suda et al.
6,917,770 B2 7/2005 Bae et al.
7,024,125 B2 4/2006 Ishii et al.

OTHER PUBLICATIONS

U.S. Appl. No. 11/644,277, filed Dec. 22, 2006 to DiRubio et al.
U.S. Appl. No. 11/644,276, filed Dec. 22, 2006 to Burry et al.

* cited by examiner

*Primary Examiner*—David M Gray
*Assistant Examiner*—Bryan P Ready
(74) *Attorney, Agent, or Firm*—Oliff & Berridge, PLC

(57) ABSTRACT

A xerographic marking engine adjusts a charging actuator, such as an AC peak-to-peak voltage or an AC peak-to-peak AC current, based upon toner patch density measurements made using, e.g., a toner patch density sensor. The sensor is used to detect a knee in a toner mass density curve obtained by sweeping an AC peak-to-peak voltage or an AC peak-to-peak current. Once the knee is located, an AC charging actuator peak-to-peak voltage or AC peak-to-peak current is determined that reduces the amount of positive charge that is deposited onto the surface of the photoconductor, thereby extending its life while maintaining acceptable print quality. The described approach may improve photoconductor life without significantly increasing production costs or complexity.

20 Claims, 8 Drawing Sheets

MASS-BASED SENSING OF CHARGING KNEE FOR ACTIVE CONTROL OF CHARGER SETTINGS

CROSS-REFERENCE TO RELATED APPLICATIONS

This application is related to U.S. patent application Ser. No. 11/644,277, filed Dec. 22, 2006, by Christopher A. DiRubio, Mike Zona, Charles A. Radulksi, Aaron M. Burry, and Palghat S. Ramesh, and entitled, "Method of Using Biased Charging/Transfer Roller as In-Situ Voltmeter and Photoreceptor Thickness Detector;" U.S. patent application Ser. No. 11/644,276, filed Dec. 22, 2006, by Aaron M. Burry, Christopher A. DiRubio, Paul C. Julien, Eric S. Hamby, Palghat S. Ramesh, Mike Zona, and William C. Dean, and entitled, "Improved Photoconductor Life Through Active Control of Charger Settings;" and U.S. Pat. No. 6,611,665, filed Jan. 18, 2002, by Christopher A. DiRubio, Charles A. Radulski, Alexander J. Fioravanti, and entitled, "Method and Apparatus sing a Biased Transfer Roil as a Dynamic Electrostatic Voltmeter for System Diagnostics and Closed Loop Process Controls." The disclosures of the related applications are incorporated by reference in their entirety.

BACKGROUND

This disclosure generally relates to control of xerographic marking engines, such as copiers and laser printers.

The basic xerographic process used in a xerographic imaging device generally involves an initial step of charging a photoconductive member to a substantially uniform potential, $V_{charge}$. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the document being produced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in an image configuration.

Control of the initial field strength, $V_{charge}$, and uniformity of the charge on the photoconductive member is very important because consistently high-quality reproductions are best produced when a uniform charge having a predetermined magnitude is obtained on the photoconductive member. In discharge area development, if the photoconductive member is overcharged, the electrostatic latent image obtained upon exposure will be relatively weak and the resulting deposition of development material will be correspondingly decreased. As a result, the copy produced by an overcharged photoconductor will be faded. Moreover, if the photoconductive member is excessively overcharged, the photoconductive member can become permanently damaged. If, however, the photoconductive member is not charged to a sufficient level, too much developer material will be deposited on the photoconductive member. The copy produced by an undercharged photoconductor will have a gray or dark background instead of the white background of the copy paper. In addition, areas intended to be gray will be black and tone reproduction will be poor.

The life of the photoconductor in a xerographic marking engine, is typically limited by the occurrence of some form of print quality defect related to the photoconductor. One of the typical failure mechanisms is the slow wearing away of the surface layer of the photoconductor. Eventually, after enough of the surface layer has been worn away, print quality defects begin to appear in the image prints generated using the worn photoconductor. An example of this type of defect is the charge deficient spots (CDS) defect that appears in some print engines after approximately 10-12 um of the photoconductor outer layer, i.e., the charge transport layer (CTL) has been worn away.

Since photoconductors are typically somewhat expensive to replace, the life of a print engine's photoconductor can have a significant impact on the overall operational costs of the print engine.

SUMMARY

Many xerographic marking engines make use of contact AC-biased charging devices such as biased charging rolls (BCRs). This type of charging device uses an AC waveform with a DC offset bias. For systems that use this type of contact charging device, the rate of wear of the photoconductor is determined, in large part, by the amount of positive charge species (e.g. ions) deposited onto the surface of the photoconductor. These positive charge species interact with the surface layer of the photoconductor and result in an accelerated wear of the surface material. The magnitude of the AC peak-to-peak charging voltage or AC peak-to-peak charging current applied to the charging device determines, in large part, the amount of positive charge deposition that occurs on the photoconductor surface. In other words, for a given DC offset voltage, larger peak-to-peak amplitudes for the applied AC voltage or applied AC current typically result in larger amounts of positive charge being deposited onto the photoconductor surface for each charging cycle. These larger amounts of positive charge applied to the photoconductor surface cause the photoconductor surface to wear more rapidly.

The AC peak-to-peak driving voltage or the AC peak-to-peak driving current used to drive the AC-biased charging device typically is not actively adjusted. Rather, this AC charging actuator value is determined as part of the initial design of the engine and then remains fixed. The DC offset voltage for the AC-biased charging device is, in many engines, adjusted as part of the normal process controls to help maintain consistent output developed mass. However, the AC charging actuator is not actively adjusted during normal operation. Thus, a tradeoff is made at design time regarding the expected operational life and performance of the photoconductor, the AC charging actuator applied to the photoconductor's AC-biased charging device and the acceptable amount of excess positive charge deposited onto the photoconductor surface.

A plot of the photoconductor surface voltage initially increases linearly with the applied AC charging actuator values and then becomes asymptotic beyond a point that is identified as the "knee." In normal printing operation, the AC charging actuator is kept fixed at a value above the "knee" which gives a uniform charging voltage on the photoconductor whose value is determined by the DC offset. Recently, a strategy has been proposed for significantly improving the life of the photoconductor, and therefore its operational cost performance, in a xerographic marking engine through active adjustment of the AC charging actuator driving the AC-biased charging device that charges the photoconductor. More specifically, the AC charging actuator may be actively adjusted in an effort to satisfy two constraints: reducing the amount of positive charge that is deposited onto the surface of the photoconductor, thereby extending its life, and maintaining an acceptable distance between an actuator setting and the knee of the charging curve in order to minimize the possibility for the occurrence of charging related print quality defects. Such active control of AC charging actuator settings for contact AC-biased charging devices has been found to improve photoconductor life by factor of 2.5.

This control strategy includes a method for obtaining the position of a knee of a charging curve of a photoconductor. This should be performed periodically since the charging curve shifts with age of the photoconductor as well as with the operational environment. One approach for obtaining the position of the knee in the photoconductor charging curve is to use an electrostatic voltmeter to directly measure the charging curve of the photoconductor. Such electrostatic voltmeters are generally rigidly secured to the reproduction machine adjacent the moving surface of a photoconductor and measure the voltage level of the photoconductor surface as it traverses an electrostatic voltmeter probe. By measuring the charge on the photoconductor surface in response to a range of AC charging actuator values applied to the photoconductor's AC-biased charging device, the charging curve of the photoconductor may be determined and the AC charging actuator value corresponding to a knee in the photoconductor's charging curve may be identified.

Other alternate charge sensing methods such as using a biased charging roll or a biased transfer roll as an electrostatic voltmeter have been considered. For example, U.S. Pat. No. 6,611,665 to DiRubio et al., incorporated by reference in its entirety, above, outlines a method for using a biased transfer roll device as an electrostatic voltmeter sensor.

The present disclosure proposes a mass-based sensing technique to locate the knee in the charging curve of a photoconductor. More specifically, the methodology proposes using an extended toner area coverage (ETAC) sensor or an area density coverage (ADC) sensor. One of these two sensors, i.e., either an ETAC or an ADC, is typically located near each photoconductor, or on an intermediate belt that is positioned proximate to the respective photoconductors and that receives toned mages from each of the respective photoconductors. An exemplary technique includes operating the AC-biased charging device through a range of AC charging actuator values and measuring the toner density of a solid area patch produced by the printer engine for each of the respective AC charging actuator values. The knee in the toner density curve for a photoconductor has been observed to correlate well with the knee in the charging curve for the same photoconductor. By using such a toner density curve-based technique, the AC charging actuator value associated with a knee in the toner density curve may be identified for each photoconductor used within a xerographic printer. The AC charging actuator value associated with a knee in such a toner density curve corresponds closely to the AC charging actuator value associated with a knee in the photoconductor charging curve. Therefore, the determined AC charging actuator value associated with a knee in such a toner density curve may be used to determine an AC charging actuator value for use in driving the xerographic printer AC-biased charging device that places the charge $V_{charge}$ on the photoconductor associated with the generated toner density curve.

An AC charging actuator value for an AC-biased charging device may be determined in such a manner during a diagnostic mode that may be periodically invoked by the xerographic printer based upon a predetermined number of printed pages printed since previously setting the AC charging actuator value and/or based upon a predetermined period of time elapsing since previously setting the AC charging actuator value.

The disclosure describes a method of obtaining an AC charging actuator value for use during marking by a marking engine, the method includes, powering an AC-biased charging device at a plurality of AC charging actuator values, applying a bias charge to a photoconductor with the AC-biased charging device powered at each of the plurality of AC charging actuator values, exposing a solid area patch (100% area coverage) on the charged photoconductor surface using a predetermined exposure intensity level at each of the respective plurality of the AC charging actuator values, developing an exposed solid area patch with toner using a predetermined development electrode voltage at each of the respective plurality of the AC charging actuator values, measuring a density of the toner patch for each of the respective plurality of AC, charging actuator values, determining an AC charging actuator value applied to the AC-biased charging device that corresponds to a knee in the plot of the measured toner patch densities, and setting an AC charging actuator value for use in powering the AC-biased charging device during a marking operation based upon the AC charging actuator value corresponding to the knee in the plot of the measured toner patch densities.

Further, the disclosure describes a marking engine that supports a diagnostic mode in which a power level is determined for use during a normal operating mode, the marking engine including, a diagnostic mode controller that selects a plurality of electrical power levels, a charge device controller that supplies each of the selected electrical power levels to a bias charge actuator that establishes a charge on a photoconductor based upon the supplied electrical power level, a marking engine that disposes a predetermined toned patch on the charged photoconductor for each of the plurality of electrical power levels, a toner mass sensor that measures a density of the applied toned patch for each of the plurality of electrical power levels, a knee evaluator unit that determines a level of electrical power applied to the charge bias actuator that corresponds to a knee in a plot of measured densities of the applied toned patch, and a charger setpoint unit that sets a value for the level of electrical power for use in powering the charge bias actuator during a normal operating mode of the marking engine based upon the level of electrical power corresponding to a knee in the measured densities of the applied toned patch.

Exemplary embodiments actively adjust the AC charging actuator value, for example, an AC peak-to-peak driving voltage for an AC-biased charging device or an AC peak-to-peak driving current for an AC-biased charging device, based upon toner patch density measurements made using a sensor such as an area coverage or density coverage sensor. Once the knee in the toner density curve for a photoconductor is located, an AC charging actuator value may be determined that reduces the amount of positive charge that is deposited onto the surface of the photoconductor, thereby extending its life, and maintaining an acceptable distance between an AC charging actuator setting and the knee of the charging curve in order to minimize the possibility for the occurrence of charging related print quality defects.

BRIEF DESCRIPTION OF THE DRAWINGS

Exemplary embodiments will be described with reference to the accompanying drawings, where like numerals represent like parts, and in which.

EMBODIMENTS

Figure 1:
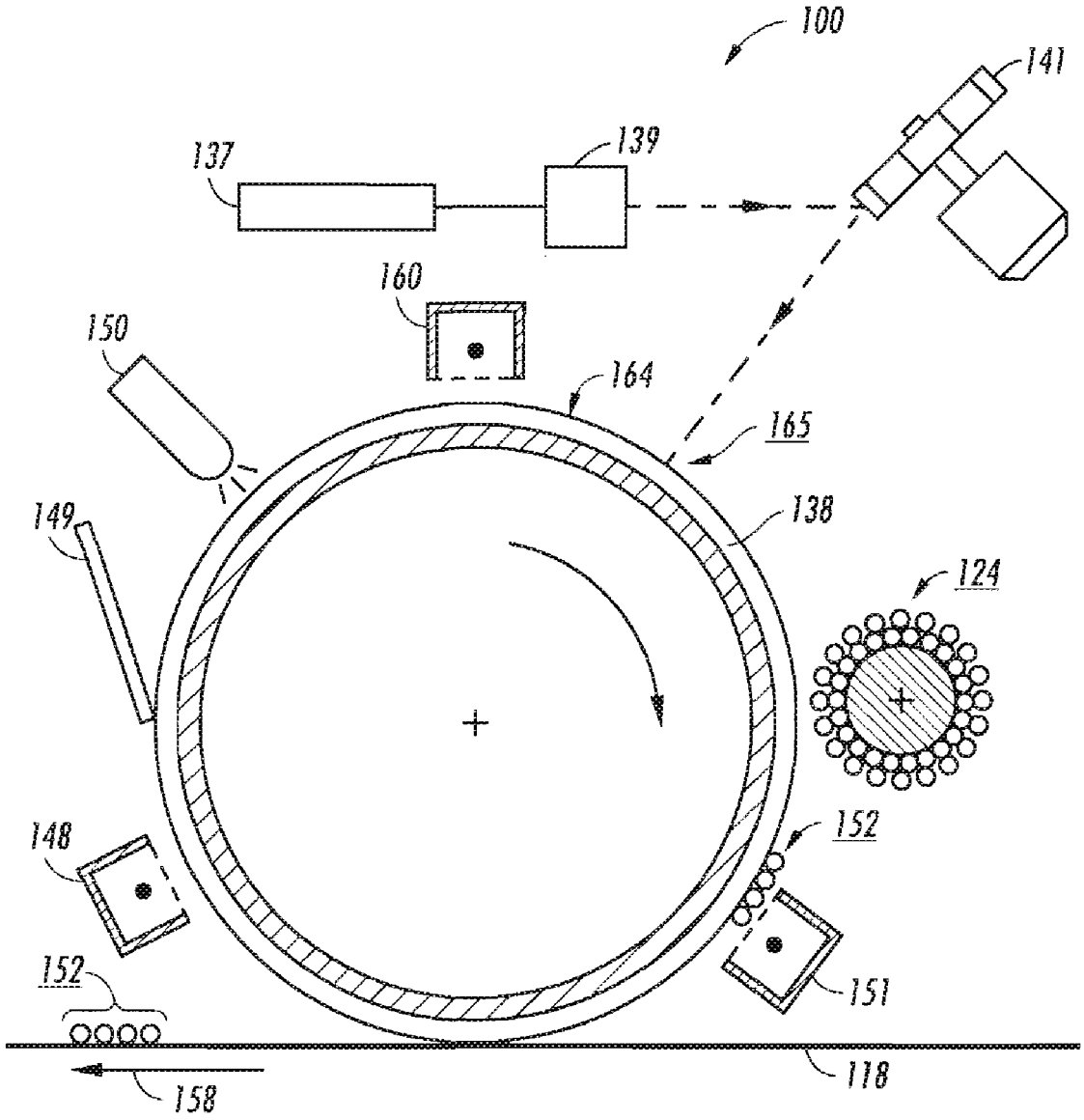
FIG. 1 is a detailed schematic of an exemplary xerographic unit.

Referring to FIG. 1, an exemplary xerographic marking unit 100 will be described, which can be used within a black and white or multicolor copier or laser printer. For example, when such a xerographic marking unit 100 is used within a color copier, a multicolor original document is positioned on a raster input scanner (RIS) that captures the entire image from original document which is then transmitted to a raster output scanner (ROS) 137. The raster output scanner 137 generates light that passed through a collimating lens 139 and is reflected from rotating multi-faceted mirror 141 to illuminate a charged portion of a photoconductor 164 of a photoconductor drum (OPC) 138, or photoconductor drums 138, of a xerographic marking unit 100. While a photoconductor drum 138 has been shown and described, the photoconductor surface 164 may be a type of belt or other structure. The raster output scanner 137 exposes each photoconductor drum 138 to record one of the subtractive primary latent images, in the case of a color system, or the single photoconductor, in the case of black and white.

Continuing with FIG. 1, one latent image is to be developed with a cyan developer material, which is a type of toner 124. Another latent image is to be developed with magenta developer material, a third latent mage is to be developed with yellow developer material, and a fourth latent image is to be developed with black developer material, each on their respective photoconductor drums 138. These developed images 152 are charged with a pre-transfer subsystem 151 and sequentially transferred to an intermediate belt 118, and subsequently transferred to a copy sheet (not shown in FIG. 1) in superimposed registration with one another to form a multicolored image on the copy sheet which is then fused to the copy sheet to form a color copy. The photoconductor drum 138 is cleaned after the transfer with the use of a pre-clean subsystem 148, a clean subsystem 149 and an erase lamp 150.

Referring to FIG. 1, initially, a portion of each of the photoconductor drums 138 passes through a charging station 160. At the charging station 160, a contact AC-biased charging device, e.g., a bias charging roller, or other charging device generates a charge voltage to charge the photoconductive surface 164 of each photoconductor drum 138 to a relatively high, substantially uniform voltage potential ($V_{OPC}$).

As shown in FIG. 1, each charged photoconductor drum 138 is rotated to an exposure station 165. Each exposure station 165 receives a modulated light beam corresponding to information derived by raster input scanner having a multicolored original document positioned thereat. Alternatively, in a laser printing application the exposure may be determined by the content of a digital document. The modulated light beam impinges on the surface 164 of each photoconductor drum 138, selectively illuminating the charged surface 164 to form an electrostatic latent image thereon. The photoconductive surface 164 of each photoconductor drum 138 records one of three images representing each color Cyan, Magenta and Yellow. The fourth photoconductor drum 138 records the black image. In a black and white printing mode, only the fourth photoconductor drum 138 is used.

Continuing to refer to FIG. 1, after the electrostatic latent images have been recorded on photoconductor drum 138 for each of four xerographic units 100, the full color image is assembled on intermediate transfer belt 118 in four first transfer steps, one for each of the primary toner colors, as the intermediate transfer belt 118 advances in direction 158. Xerographic units 100 respectively, apply toner particles of a specific color on the photoconductive surface 164 of each photoconductor drum 138.

Figure 2:
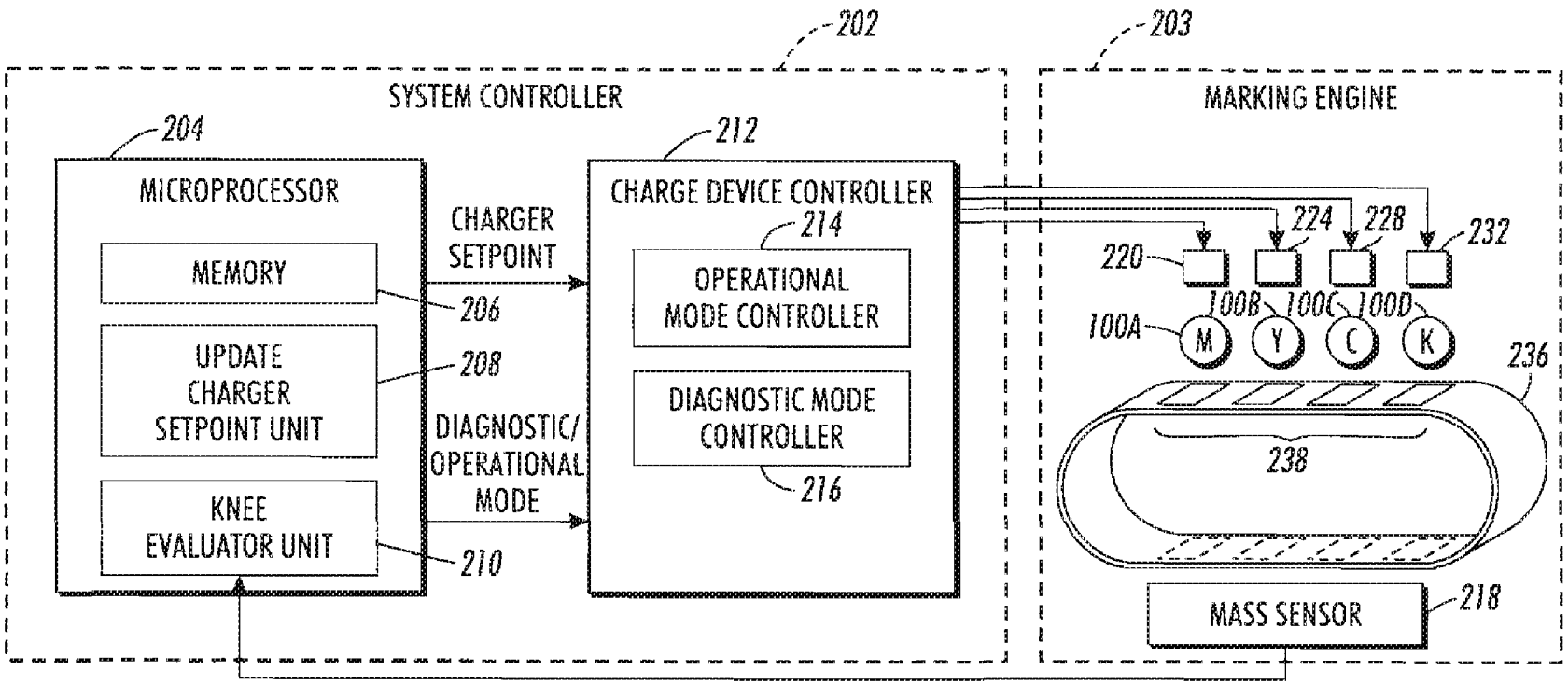
FIG. 2 is a system level schematic of an exemplary xerographic system that incorporates the exemplary xerographic unit of FIG. 1.

FIG. 2 is a system level schematic of an exemplary xerographic printer system. As shown in FIG. 2, an exemplary xerographic printer system 200 may include a system controller 202, and a marking engine 203. The system controller may include, among other features, a microprocessor 204 and a charge device controller 212.

Microprocessor 204 may include a memory 206 and stored executable instructions, in the form of software, firmware, or other form of stored executable instructions that may be executed by microprocessor 204. For example, as shown in FIG. 2, in addition to other sets of executable instructions, microprocessor 204 may include or have access to a knee evaluator unit 210 and an update charger setpoint unit 208.

Charge device controller 212 may include an operational mode controller 214 and a diagnostic mode controller 216.

Xerographic marking engine 203 may include a plurality of xerographic marking units 100A, 100B, 100C and 100D, each as described above with respect to FIG. 1, and each configured to support the printing of latent images with a single color of toner. Each xerographic marking unit may include a charging device 220, 224, 228 and 232, such as a bias charging roller, that receives an AC charging actuator, from charge device controller 212. In addition, marking engine 203 may include an image transfer belt 236 that receives toner patches 238 from the respective xerographic marking units 100A, 100B, 100C and 100D during a diagnostic mode and receives toned images during an operational mode. In addition, marking engine 203 may include a toner mass sensor 218, such as an ETAC or ADC, to determine a mass of toner patches applied to the intermediate transfer belt by the respective xerographic marking units.

In operation, the system controller microprocessor 204 may initiate a diagnostic mode based upon the values of one or more parameters stored in memory 206. These values may be periodically updated based upon an internal clock and/or based upon one or more printer engine performance parameters monitored by system controller 202. For example, as addressed in detail below, a diagnostics mode may be initiated based on a printed page counter exceeding a maximum page count and/or based on exceeding a maximum allowed period of time since the diagnostics mode was last executed.

As addressed in greater detail with respect to FIG. 3, below, upon receiving a signal from microprocessor 204 to enter an AC charging actuator setpoint diagnostics mode, charge device controller 212 may drive the respective bias charging devices 220, 224, 228 and 232 with a plurality of AC charging actuator values within a predetermined range. For each applied AC charging actuator value, marking engine 203 may generate a mass density measurement based upon ETAC or ADC measurements of a toner patch generated by a xerographic marking unit in response to each new AC charging actuator value received during diagnostics mode.

Knee evaluator unit 210 may store the respective mass density measurements received from toner mass sensor 218 in memory 206. Upon completion of the last AC charging actuator value associated with the applied range, and after having received and stored all toner mass sensor 218 measurements to be produced in association with the applied range, knee evaluator 210 may retrieve the stored toner patch mass density values from memory and determine an AC charging actuator value associated with a knee in the resulting mass-based charge curve.

Update charger setpoint unit 208 may then receive an estimated AC charging actuator value associated with a knee in the mass-based charge curve and determine a new setpoint value that may be transmitted from microprocessor 204 to charge device controller 212 for use in controlling the AC charging actuator values applied to each of the respective bias charging devices in marking engine 203 when operating in normal operational mode.

Figure 3:
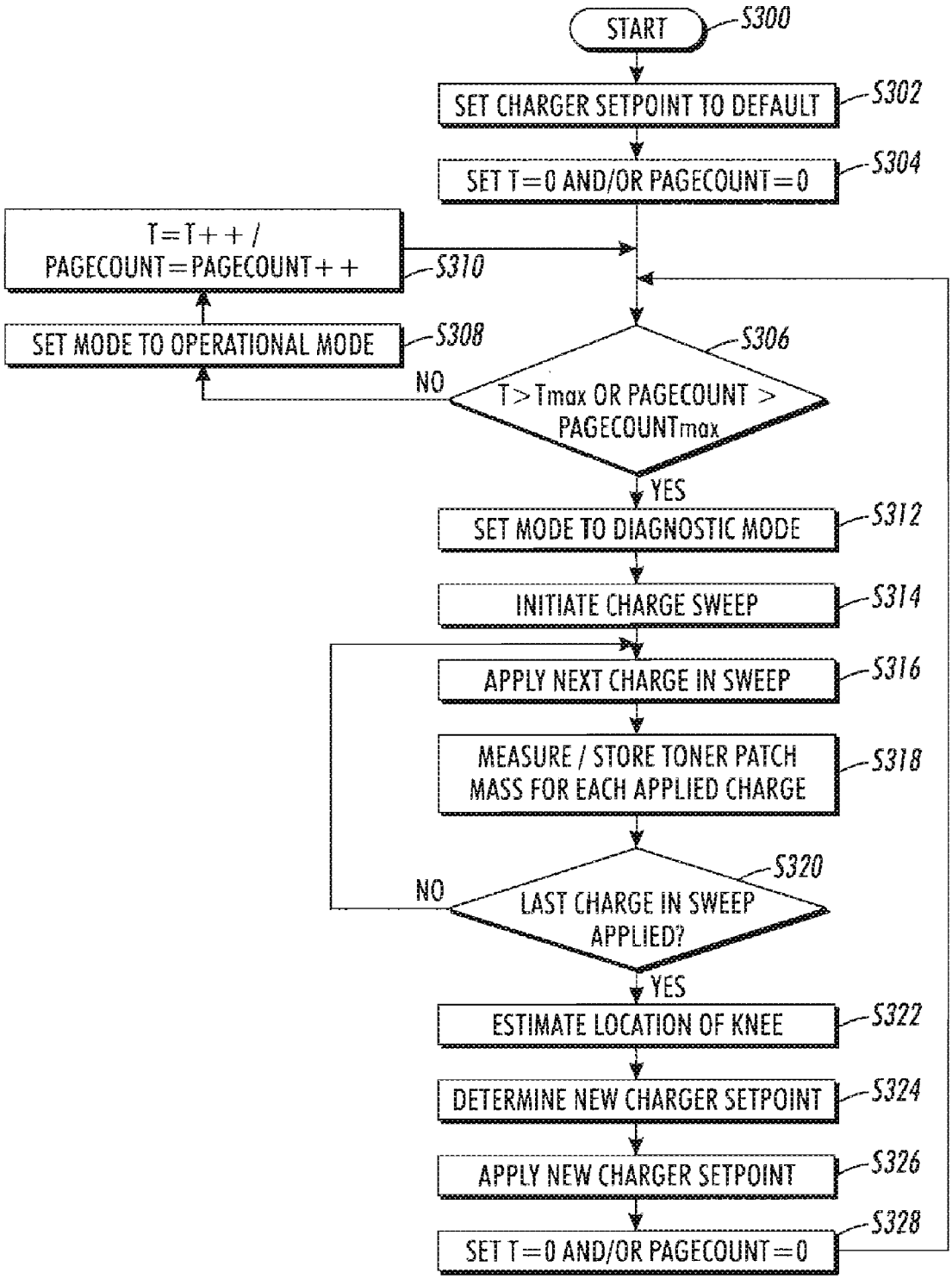
FIG. 3 is a flowchart illustrating of an exemplary method for determining an AC charging actuator value.

FIG. 3 is a flow diagram of an exemplary method for determining a new AC charging actuator value for each photoconductor in a printer system according to this disclosure. As shown in FIG. 3, operation of the method begins at step S300 with the startup of a xerographic printer and proceeds to step S302.

In step S302, a value of an AC charging actuator peak-to-peak voltage, or AC current, used to drive a bias charging roller or other charging device that places a charge, $V_{charge}$, upon a surface of a photoconductor within the xerographic marking engine is set to a value stored in non-volatile memory accessible by the xerographic marking system controller. Operation of the method continues to step S304.

In step S304, a parameter T used to track a period of time since the AC charging actuator value has been updated is set to zero, and/or a page count parameter, PageCount, that holds a count of the number of printed pages generated by the xerographic printer since the charging setpoint has been updated is set to zero. Operation of the method continues to step S306.

If, in step S306, T holds a time duration value less than that a predetermined maximum time duration value $T_{max}$ or if PageCount holds a count of printed pages less than a maximum count $PageCount_{max}$, operation of the method continues to step S808. Otherwise, else operation of the method continues to step S312.

In step S308, a stored mode parameter that determines an operation mode in which the xerographic printer operates is set to "operational mode." While in "operational mode" the xerographic generates printed output in response to user requests. Next, at step 310, the T and/or PageCount values are incremented based upon counter values and/or timers maintained by the xerographic printer system controller. Operation of the method continues to step S306.

In step S312, the stored mode parameter that determines an operation mode in which the xerographic printer operates is set to "diagnostic mode." While in "diagnostic mode" the xerographic printer system controller performs a diagnostic routine that determines and stores a new AC charging actuator value for each photoconductor within the xerographic printer. Operation of the method continues to step S314.

In step S314, the Charge Device Controller initiates a sweep, i.e., through a plurality of AC charging actuator values within a predetermined range. Specifically, in step 316, the Charge Device Controller selects a next voltage within a range of AC charging actuator values and instructs one or more photoconductors within the xerographic printer to generate, at step 318, a toner patch. The density of the toner patch is measured using a toner mass sensor such as an ETAC or ADC sensor, and the determined value is stored in a memory store accessible to the system controller. Operation of the method continues to step S320.

If, in step S320, it is determined that the last charge values in the predetermined range has been applied, operation of the method continues to step S322; otherwise, operation of the method resumes at step S316 and a next charge value in the predetermined range has been applied, as addressed above.

In step S322, the system controller retrieves the plurality of stored patch density measurements stored in memory during the above-described sweep through the predetermined range and determines, based upon the stored patch toner mass measurements, a knee in the toner mass measurements that represents a response of the photoconductor in the xerographic marking unit to the sweep of bias charging device AC charging actuator values. Operation of the method continues to step S324.

In step S324, the system controller determines a new AC charging actuator value based upon the determined knee value, as addressed in greater detail below, stores the new AC charging actuator value within a non-volatile memory accessible by the xerographic marking system controller. These new AC charging actuator value(s), i.e., one AC charging actuator value is determined for each photoconductor within the xerographic printer, may be provided by the system controller, at step S326, to the charge device controller for use in controlling the bias charging device associated with each of the respective photoconductors within the xerographic printer. Operation of the method continues to step S328.

In step S328, the parameter T used to track a period of time since the charging setpoint has been updated is reset to zero, and/or a page count parameter, PageCount, that holds a count of the number of printed pages generated by the xerographic printer since the charging setpoint is also reset to zero. Operation of the method continues to step S306.

The process described above with respect to FIG. 3 may be repeated periodically by the system controller until the xerographic system is powered down. Intervals between execution of the above process to update the charging setpoint may be controlled based upon the values of $T_{max}$ and $PageCount_{max}$, which may be user configurable values and/or may be dynamically updated based upon lookup tables which provide a value of $T_{max}$ and/or a value for $PageCount_{max}$ based upon such factors as the type, or model of photoconductor and/or age of the photoconductor and/or other factors monitored by the xerographic printer system controller.

Figure 4:
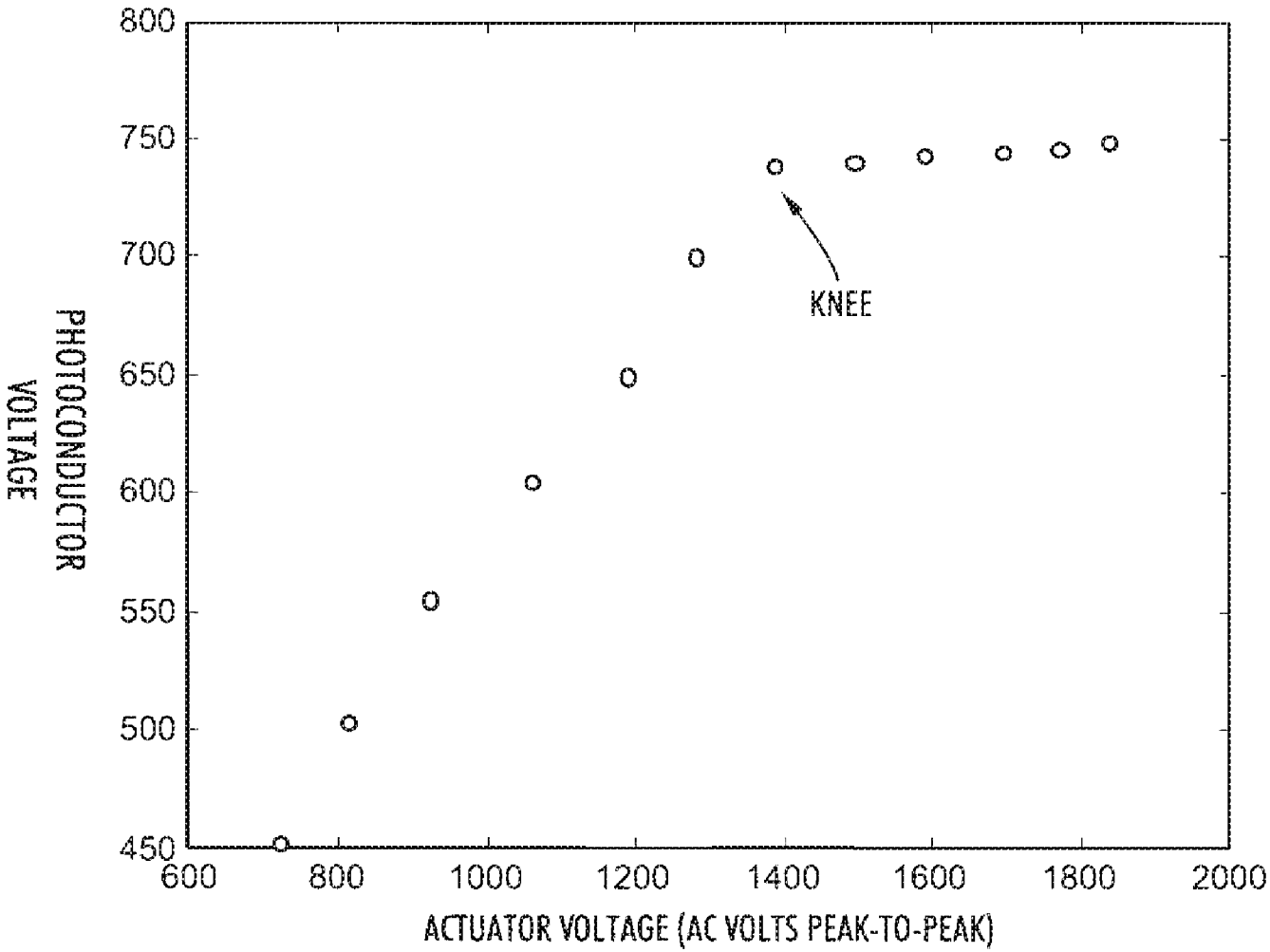
FIG. 4 is a plot of measured photoconductor surface voltages generated in response to various AC charging actuator values applied by an AC-biased charging device.

FIG. 4 is a plot of measured photoconductor surface voltages generated in response to a sweep of bias charging device AC charging actuator values. Specifically, FIG. 4 presents a voltage measured on a photoconductor, on the y-axis, as a function of all AC peak-to-peak voltage signal supplied to a bias charge roller (BCR) used to place the measured charge on the photoconductor. The data presenting in FIG. 4 was obtained by sweeping the BCR AC peak-to-peak voltage and measuring the photoconductor surface voltage ($V_{charge}$) with an electrostatic voltmeter sensor.

As seen in FIG. 4, a plot of the photoconductor surface voltage initially increases linearly with the applied AC charging actuator values and then becomes asymptotic beyond a point that is identified as the "knee." For reasons addressed below in greater detail, the AC charging actuator value chosen for use to generate printed pages in operational mode should be greater than the AC charging actuator value at the charge curve knee. In an exemplary embodiment, the AC charging actuator should be about 150 to about 250 volts AC peak-to-peak greater than the AC charging actuator value at the mass-based charge curve knee.

Since positive charge deposition onto its surface is known to drive the rate of wear of the photoconductor in xerographic systems with contact AC charging devices, the selection of the operating value for the contact AC charging actuator is very important from a photoconductor device life point of view. Therefore, a second parameter for the choice of the AC charging actuator setting is the uniformity of the resultant charged voltage on the photoconductor. Non-uniformities on the photoconductor may translate to undesirable non-uniformities in the output prints. Thus, care should be taken with respect to how the AC charging actuator value is chosen to prevent or reduce the occurrence of print quality defects.

Figure 5:
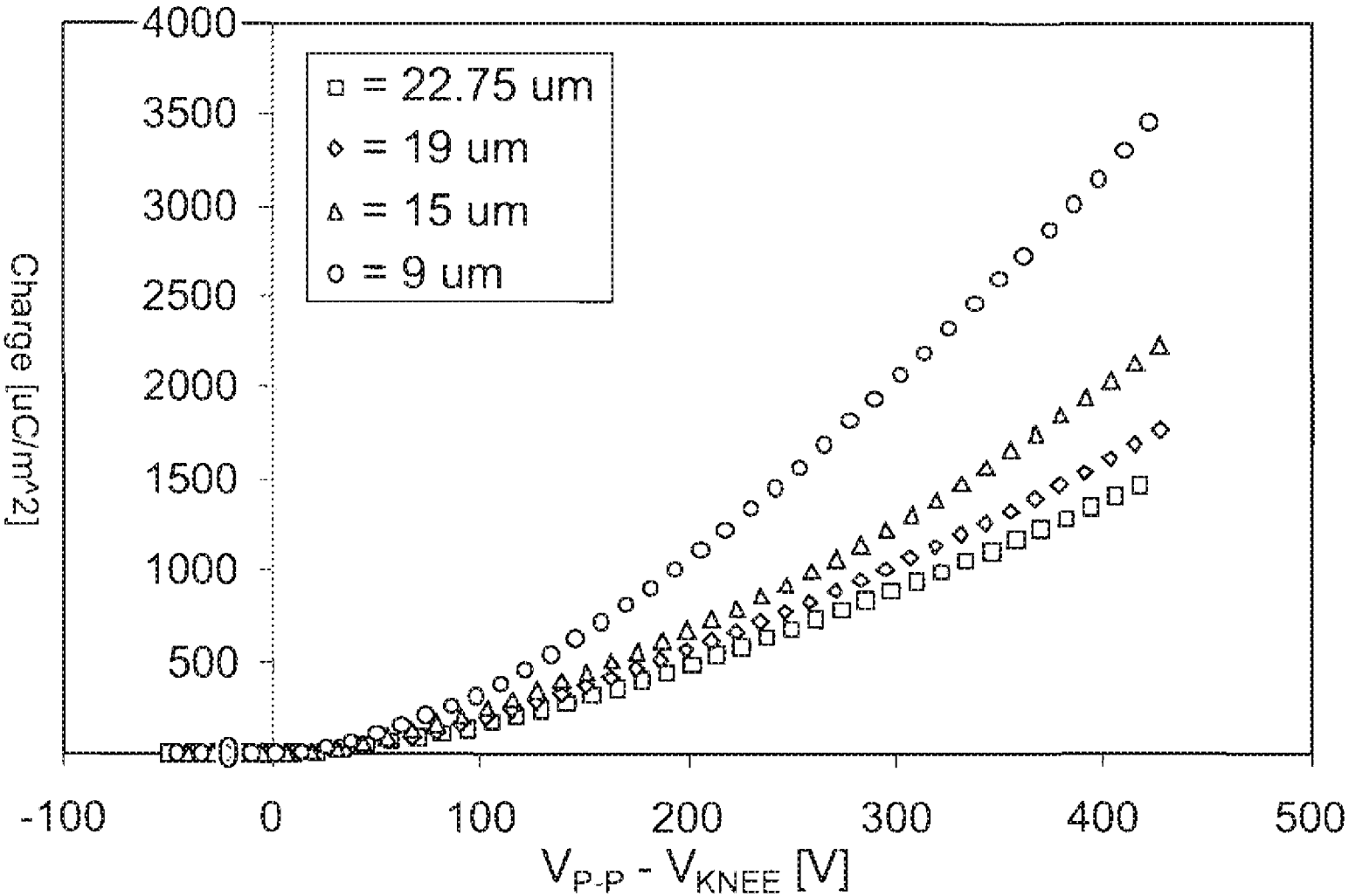
FIG. 5 is a plot of the positive charge deposited on the surface of the photoconductor as a function of AC charging actuator values equal to and greater than the AC charging actuator value corresponding to a knee in the photoconductor charging curve, for various photoconductor CTL thicknesses.

For example, FIG. 5 is a plot of estimated positive charge deposition on the photoconductor surface as a function of AC charger actuator values greater than the knee in photoconductors of various CTL thicknesses. As demonstrated by FIG. 5, positive charge deposition on the photoconductor rises dramatically for photoconductor surfaces of all thickness, but thinner photoconductors, e.g. approximately 9 um in thickness, are subject to an even greater increase in positive charge deposition than are thicker photoconductors. Higher positive charge deposition will increase the rate of deterioration of the respective photoconductors. Such deterioration will eventually result in print defects. Therefore, based upon the results presented in FIG. 5, AC charging actuator values are preferably set close to the knee to prevent unnecessary accumulation of positive charge and a correspondingly higher rate of wear of photoconductor surfaces.

Figure 6:
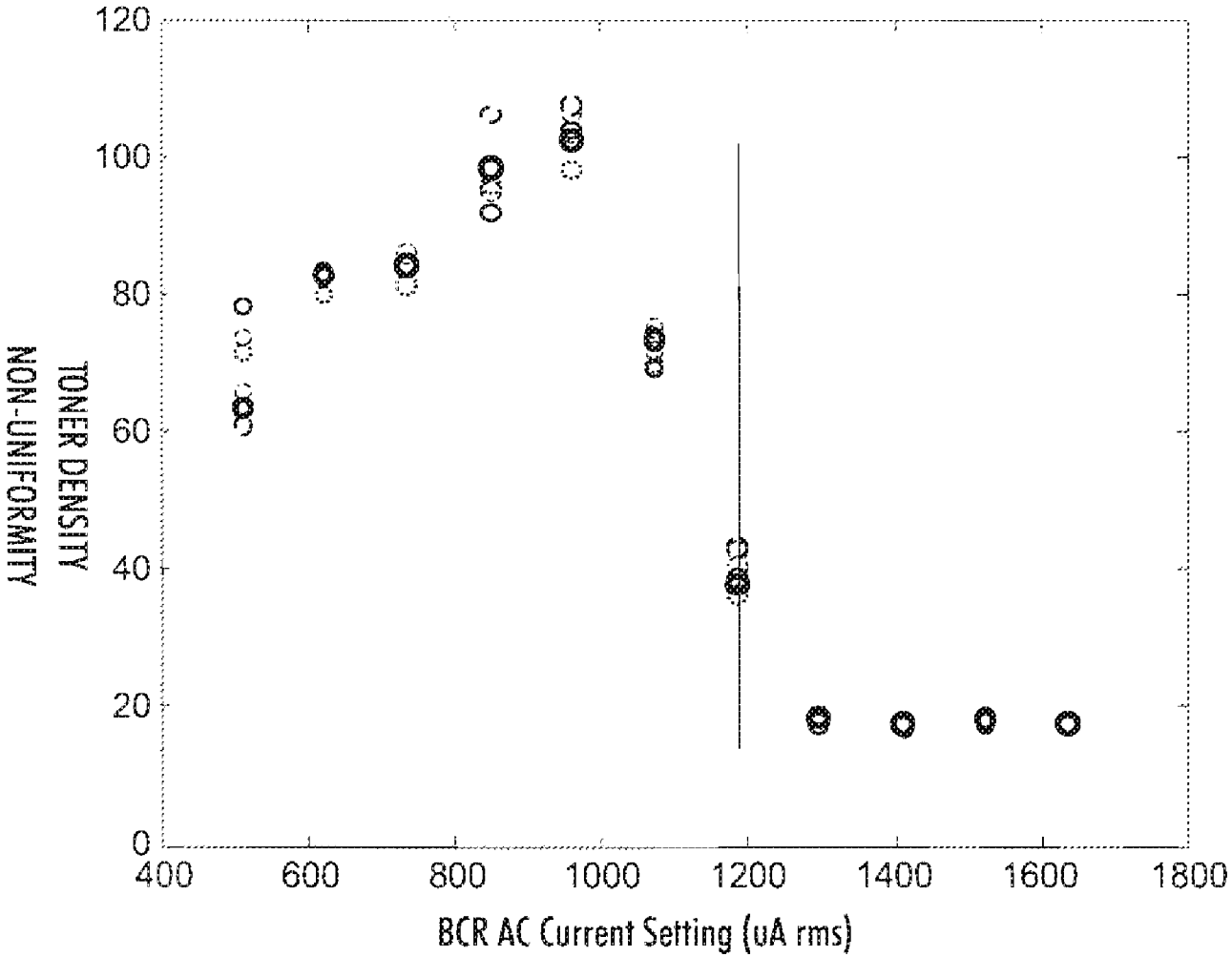
FIG. 6 is a plot of toner density non-uniformity as a function of AC charging actuator values below the knee and AC charging actuator values above the knee.

However, to achieve consistency in the toner levels output by the printer device, the AC charging actuator value is preferably set to the right of the knee. For example, FIG. 6 presents plot of toner density non-uniformity, measured using a Noise at Mottle Frequency (NMF) metric, as a function of AC charging actuator values below the knee and AC charging actuator values above the knee. As demonstrated in FIG. 6, non-uniform toner densities are observed for bias charging roller voltages below the knee; however, consistent, i.e., uniform toner densities are observed for bias charging roller voltages above the knee.

Hence, based upon the data presented in FIGS. 5 and 6, in order to optimize print results and to reduce unnecessary charge and unnecessary wear on the photoconductor, the AC charging actuator value should be set close to, but greater than, the AC charging actuator value corresponding to the knee in the photoconductor charge results.

Another consideration to take into account is that the AC charging actuator value corresponding to the knee varies due to component wear and environmental conditions, such as humidity, temperature, age of the toner, number of pages processed by the photoconductor, and/or the age of the photoconductor.

By selecting the AC charging actuator value slightly greater than the knee, the location of the knee may vary, slightly for a variety of reasons without introducing print defects in generated printouts. However, by placing the AC charging actuator value relatively close to the knee, excessive positive charge, and hence, excessive wear may be avoided. For example, in an exemplary embodiment, by setting the AC charging actuator value from about 100 to about 200 volts AC peak-to-peak greater than the AC charging actuator value setting at the knee, provides sufficient performance with respect to both print quality performance and wear.

Figure 7:
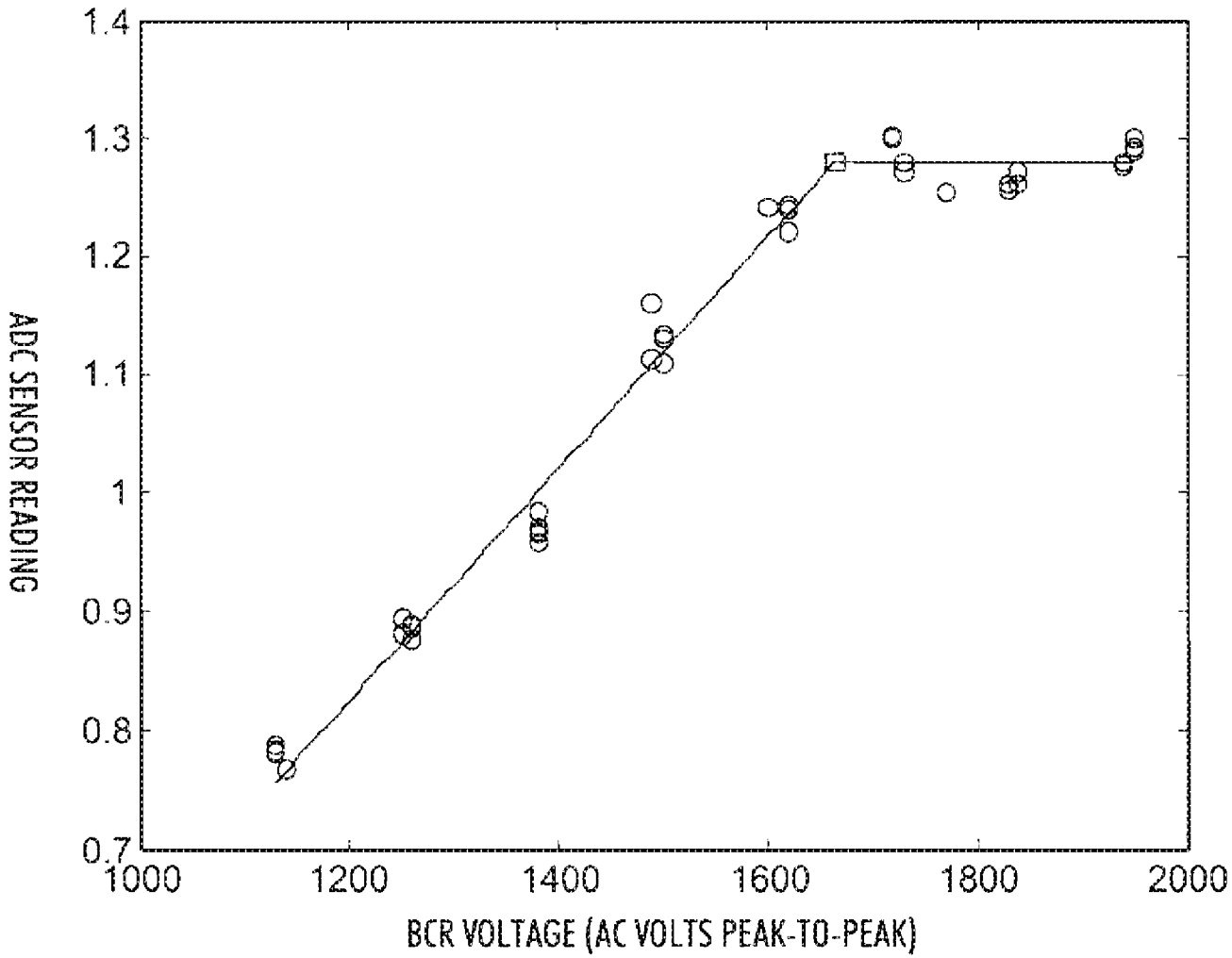
FIG. 7 is a plot of toner mass measurements using an ADC sensor generated in response to a sweep of AC charging actuator values.

FIG. 7 is a plot of toner mass measurements generated in response to a sweep of bias charging roller voltages.

As shown in FIG. 7, the density of a solid patch produced on a photoconductor as measured by an ETAC or ADC toner mass sensor may be plotted as a function of the AC charging actuator values applied. The behavior is analogous to the charge sweep data in FIG. 1.

Figure 8:
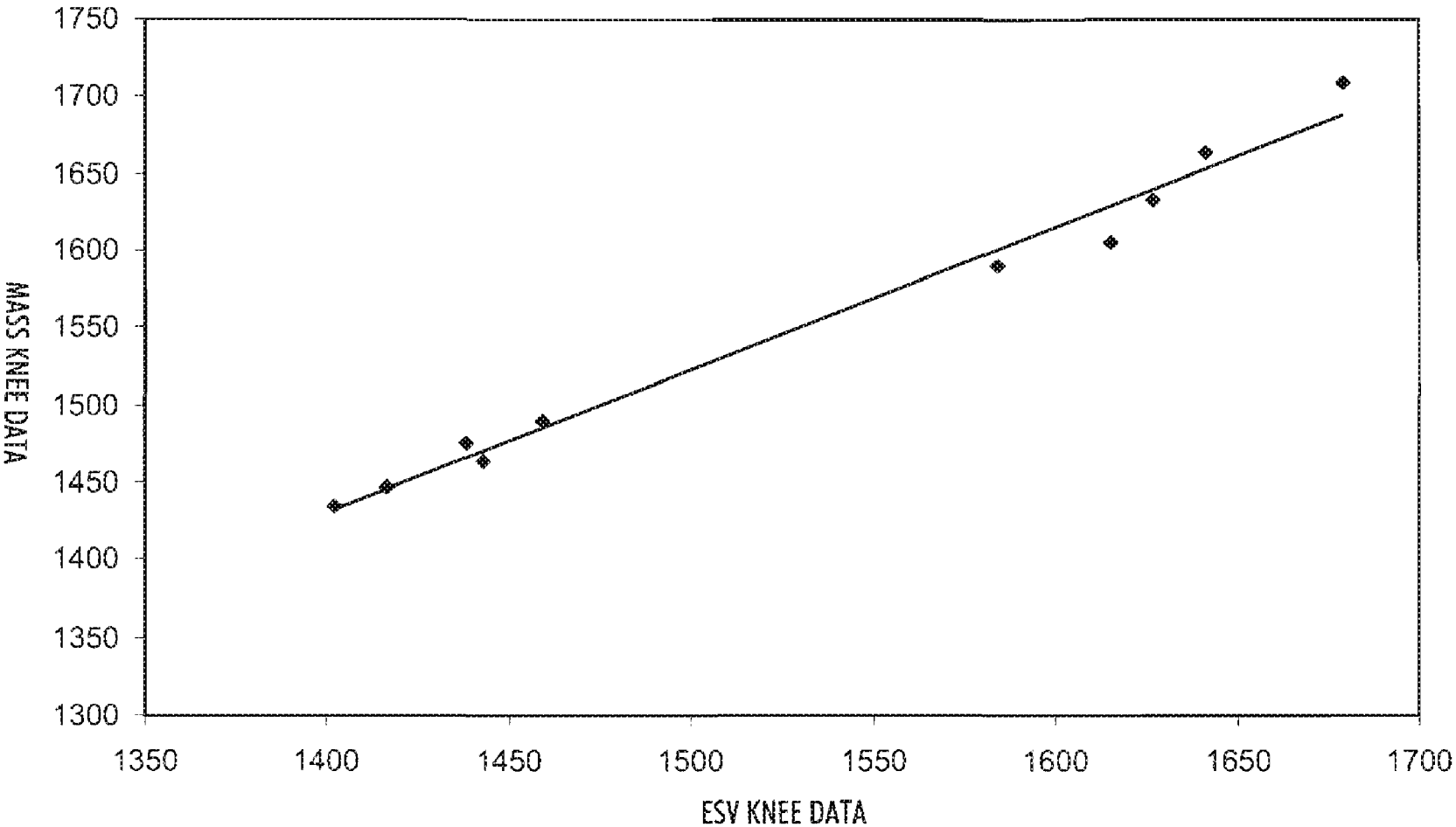
FIG. 8 is a comparison of toner patch mass-based knee location data and charge-based knee location data.

The location of the knee in a photoconductor mass-based charge curve can be identified as corresponding the AC charging actuator value at which the toner mass sensor reading becomes asymptotic. FIG. 8 presents a comparison of the knee location using the mass-based sensing technique and the more conventional technique of using an electrostatic voltmeter sensor on the photoconductor drum. As demonstrated by FIG. 8, the two techniques are extremely well correlated.

For example, based upon the data represented in FIG. 8, there is a linear relationship between the two measurement techniques. Further, an analysis of the confidence bound based upon the data represented in FIG. 8 indicates a 95% confidence bound of ±36V. Therefore, the mass-based sensing technique provides a reasonable ("good enough") estimate of the knee without having to add additional sensors, thereby increasing both complexity and cost.

For example, in an exemplary embodiment, by setting the AC charging actuator value from about 150 to about 250 volts AC peak-to-peak greater than the AC charging actuator value setting at the mass based charging knee, provides sufficient performance with respect to both print quality performance and wear. These AC charging actuator value ranges take into account the confidence bound of ±36V with respect to the accuracy of the determined AC charging actuator value and provide additional buffer to accommodate changes in age and operational conditions which could manifest as defects in the printed output of the marking system if the AC charging actuator value were not set sufficiently greater than the knee.

Even though the ±36V confidence interval on the knee location suggests a bit more conservative approach in setting the actuator value to stay above print defects, an estimated 2× improvement in photoconductor life may be achieved, as compared to a 2.5× improvement with a more accurate knee sensing techniques, such as the use of an electrostatic voltmeter sensor to monitor photoconductor charge in response to different AC charging actuator values. However, mounting an electrostatic voltmeter sensor on each of the photoconductor drums would add cost as well as complexity.

The AC charging actuator value may be set in accordance with the approach described above using a variety of techniques. For example, in one exemplary embodiment, the update charger setpoint unit 208, described above with respect to FIG. 2 and FIG. 3, may set the AC charging actuator value to a value between 110 and 250 volts above the AC charging actuator value corresponding to the knee. In another exemplary embodiment, the update charger setpoint unit may set the AC charging actuator value to a value above the AC charging actuator value corresponding to the knee based on a function of photoconductor age, photoconductor thickness, temperature and humidity. In yet another exemplary embodiment, the update charger setpoint unit may set the AC charging actuator value to a value above the AC charging actuator value corresponding to the knee that corresponds to at least one of a selected print quality attribute and a selected operational cost attribute. In still vet another exemplary embodiment, the update charger setpoint unit may set the AC charging actuator value to a value above the AC charging actuator value corresponding to the knee based on a measurement of uniformity of toner density using an inline toner uniformity sensor or an offline toner uniformity sensor. Additional exemplary embodiments may allow a user to select from one of several nodes that implement one of the above techniques and/or other techniques. Such embodiments are exemplary only.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of obtaining an AC charging actuator value for use during marking by a marking engine, the method comprising:

powering an AC-biased charging device at a plurality of AC charging actuator values;

applying a bias charge to a photoconductor with the AC-biased charging device powered at each of the plurality of AC charging actuator values;

developing a toner patch on the charged photoconductor for each of the plurality of AC charging actuator values;

measuring a density of the toner patch applied for each of the respective plurality of AC charging actuator values;

determining an AC charging actuator value applied to the AC-biased charging device that corresponds to a knee in the plot of the measured toner patch densities; and setting an AC charging actuator value for use in powering the AC-biased charging device during a marking operation based upon the AC charging actuator value corresponding to the knee in the plot of the measured toner patch densities.

2. The method of claim 1, wherein the AC charging actuator value is set higher than the AC charging actuator value corresponding to the knee in the plot of the measured toner patch densities.

3. The method of claim 1, wherein the AC charging actuator value is set between 150 and 250 volts above the AC charging actuator value corresponding to the knee.

4. The method of claim 1 wherein the AC charging actuator value is set to a value above the AC charging actuator value corresponding to the knee based on a function of photoconductor age, photoconductor thickness, temperature and humidity.

5. The method of claim 1, wherein the AC charging actuator value is set to a value above the AC charging actuator value corresponding to the knee that corresponds to at least one of a selected print quality attribute and a selected operational cost attribute.

6. The method in claim 1, wherein the AC charging actuator value is set to a value above the AC charging actuator value corresponding to the knee based on a measurement of uniformity of toner density using an inline toner uniformity sensor or an offline toner uniformity sensor.

7. The method of claim 1, further comprising:

configuring the marking engine to initiate a mode to determine an AC charging actuator value after a predetermined number of printed pages have been produced.

8. The method of claim 1, further comprising:

configuring the marking engine to initiate a mode to determine an AC charging actuator value after a predetermined period of time has elapsed since previously setting the value.

9. The method of claim 1, further comprising:

configuring the marking engine to set the AC charging actuator value after one of the earliest of and the latest of the marking engine producing a predetermined number of printed pages and a predetermined period of time elapsing since previously setting the value.

10. The method of claim 1, wherein a value is set for an AC charging actuator value associated with each AC-biased charging device associated with each photoconductor in the marking engine.

11. The method of claim 1, wherein a value is set for an AC charging actuator value for a AC-biased charging device associated with the photoconductor for each toner color used by the marking engine.

12. The method of claim 1, wherein the patch density is measured for a patch on a photoconductor.

13. The method of claim 1, wherein the patch density is measured for a patch on an intermediate substrate such as an intermediate transfer belt.

14. The method of claim 1, wherein the value is one of a peak-to-peak voltage and a rms current determined for an AC power signal.

15. The method of claim 1, wherein an initial value is set based upon at least one of the type of photoconductor and the age of the photoconductor.

16. A marking engine that supports a diagnostic mode in which a power level is determined for use during a normal operating mode, the marking engine comprising:

a diagnostic mode controller that selects a plurality of electrical power levels;

a charge device controller that supplies each of the selected electrical power levels to a bias charge actuator that establishes a charge on a photoconductor based upon the supplied electrical power level;

a marking engine that disposes a predetermined toned patch on the charged photoconductor for each of the plurality of electrical power levels;

a toner mass sensor that measures a density of the applied toned patch for each of the plurality of electrical power levels;

a knee evaluator unit that determines a level of electrical power applied to the charge bias actuator that corresponds to a knee in a plot of measured densities of the applied toned patch; and a charger setpoint unit that sets an AC charging actuator value for the level of electrical power for use in powering the charge bias actuator during a normal operating mode of the marking engine based upon the level of electrical power corresponding to a knee in the measured densities of the applied toned patch.

17. The marking engine of claim 16, wherein the charger setpoint unit sets the AC charging actuator value to a value between 150 and 250 volts above the AC charging actuator value corresponding to the knee.

18. The marking engine of claim 16, wherein the charger setpoint unit sets the AC charging actuator value to a value above the AC charging actuator value corresponding to the knee based on a function of photoconductor age, photoconductor thickness, temperature and humidity.

19. The marking engine of claim 16, wherein the charger setpoint unit sets the AC charging actuator value to a value above the AC charging actuator value corresponding to the knee that corresponds to at least one of a selected print quality attribute and a selected operational cost attribute.

20. A xerographic image forming device comprising the marking engine of claim 16.

* * * * *